US010412803B1

(12) United States Patent
Lin

(10) Patent No.: US 10,412,803 B1
(45) Date of Patent: Sep. 10, 2019

(54) LIGHTING SYSTEM, CONTROL DEVICE AND CONTROL METHOD

(71) Applicant: Wistron Corporation, New Taipei (TW)

(72) Inventor: Cheng-Hui Lin, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 16/121,614

(22) Filed: Sep. 4, 2018

(30) Foreign Application Priority Data

Jun. 15, 2018 (TW) ..... 107120623 A

(51) Int. Cl.
*H05B 33/08* (2006.01)

(52) U.S. Cl.
CPC ..... *H05B 33/0848* (2013.01); *H05B 33/0818* (2013.01)

(58) Field of Classification Search
CPC ..... H05B 33/0815; H05B 33/0818; H05B 33/0845; H05B 33/0851; H05B 33/0887; H05B 37/02; H05B 41/38; Y02B 20/346; Y02B 20/347; Y02B 20/345; H02M 3/156
See application file for complete search history.

(56) References Cited

U.S. PATENT DOCUMENTS

| | | | | |
|---|---|---|---|---|
| 7,550,934 | B1 * | 6/2009 | Deng | H05B 33/0887 315/209 R |
| 7,888,888 | B2 * | 2/2011 | Huang | H05B 33/0818 315/291 |
| 8,217,592 | B2 * | 7/2012 | Yu | H05B 33/0848 315/185 R |
| 8,339,068 | B2 * | 12/2012 | Simmers | H05B 33/0815 315/297 |
| 8,502,454 | B2 * | 8/2013 | Sadwick | H05B 33/0809 315/291 |
| 8,754,585 | B1 * | 6/2014 | Bahrehmand | H05B 33/0851 315/287 |
| 9,894,722 | B2 * | 2/2018 | Chen | H05B 33/0815 |
| 2011/0193605 | A1 * | 8/2011 | Zhao | H05B 33/0818 327/175 |

FOREIGN PATENT DOCUMENTS

| | | |
|---|---|---|
| TW | 200837699 | 9/2008 |
| TW | I498871 B | 9/2015 |

* cited by examiner

*Primary Examiner* — Haissa Philogene
(74) *Attorney, Agent, or Firm* — Winston Hsu

(57) ABSTRACT

A control device, for a light emitting diode (LED), wherein the LED is driven by a current to emit light, the control device comprising a microcontroller, coupled to the LED, for providing the current to the LED according to a current setup signal; and a pulse width modulation (PWM) circuit, coupled to the microcontroller, for generating the current setup signal, and adjusting a pulse width of the current setup signal according to a control signal, to adjust the current generated by the microcontroller.

11 Claims, 4 Drawing Sheets

LIGHTING SYSTEM, CONTROL DEVICE AND CONTROL METHOD

BACKGROUND OF THE INVENTION

1. Field of the Invention

This present invention relates to a lighting system, control device and control method, and more particularly, to a lighting system, control device and control method capable of improving the lighting precision of a light emitting diode.

2. Description of the Prior Art

In the prior art, a light emitting diode is controlled by a microcontroller and driven by a driving current generated by the microcontroller to emit light. The functionality of the microcontroller utilized for controlling the light emitting diode is simple, which may only turn the light emitting diode on or off, or adjust a lighting brightness of the light emitting diode by two levels. Under such a circumstance, the prior art adjusts the lighting brightness of the light emitting diode by replacing resistors with different resistances, in order to adjust the current flow delivered to the light emitting diode. In other words, the conventional control method may not instantly or dynamically adjust the brightness of the light emitting diode.

Therefore, how to improve the control method of the light emitting diode is a significant objective in the field.

SUMMARY OF THE INVENTION

Therefore, the primary objective of the present invention is to provide a lighting system, control device and control method capable of improving the lighting precision of the light emitting diode.

The present invention discloses a control device, for a light emitting diode (LED), wherein the LED is driven by a current to emit light, the control device comprising a microcontroller, coupled to the LED, for providing the current to the LED according to a current setup signal; and a pulse width modulation (PWM) circuit, coupled to the microcontroller, for generating the current setup signal, and adjusting a pulse width of the current setup signal according to a control signal, to adjust the current generated by the microcontroller.

The present invention discloses a control method, for controlling a microcontroller to control a light emitting diode, the control method comprising adjusting a pulse width of a current setup signal delivered to the microcontroller according to a control signal; and providing, by the microcontroller, a current to the LED and adjusting the current according to the current setup signal, to adjust a brightness of the LED.

The present invention further discloses lighting system, comprising a light emitting diode (LED), driven by a current to emit light; and a control device, comprising a microcontroller, coupled to the LED, for providing the current to the LED according to a current setup signal; and a pulse width modulation (PWM) circuit, coupled to the microcontroller, for generating the current setup signal, and adjusting a pulse width of the current setup signal according to a control signal, to adjust the current generated by the microcontroller.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
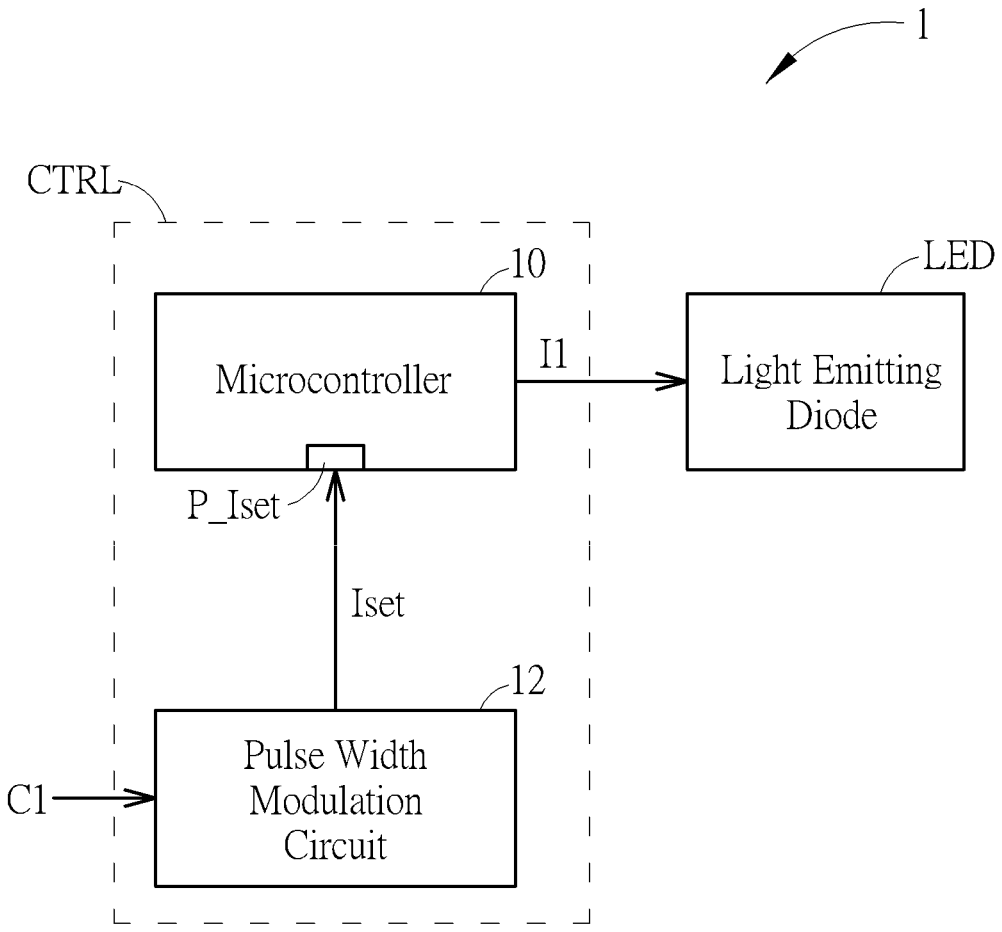
FIG. 1 is a schematic diagram of a lighting system according to an embodiment of the present invention.

Please refer to FIG. 1, which is a schematic diagram of a lighting system 1 according to an embodiment of the present invention. The lighting system 1 includes a light emitting diode LED and a control device CTRL. The control device CTRL is utilized for controlling operations of the light emitting diode LED, and includes a microcontroller 10 and a pulse width modulation (PWM) circuit 12. The microcontroller 10 is utilized for providing a current I1 to the light emitting diode LED for lighting. Notably, the current I1 generated from the microcontroller 10 to the light emitting diode LED may not be precisely adjusted, wherein the current I1 may only be turned on or off, or adjust the brightness of the light emitting diode LED by two levels. Therefore, the PWM circuit 12 of the present invention adjusts a current setup signal Iset delivered to the microcontroller 10 according to a control signal C1, for further adjusting the current I1 outputted from the microcontroller 10 to the light emitting diode LED. The lighting system 1 may be applied to different electronic systems; for instance, the lighting system 1 may be a warning module inside an electronic system, for providing information related to the electronic system to a user. In addition, the lighting system 1 may be applied to a monitor, and the lighting system 1 may receive the corresponding control signal C1 generated by the monitor, such that the light emitting diode LED may glow according to a preset program or an instruction from the user, to display images on the monitor. The lighting system 1 mentioned above may be modified according to different applications and design concepts, and the present invention is not limited thereto.

Figure 2:
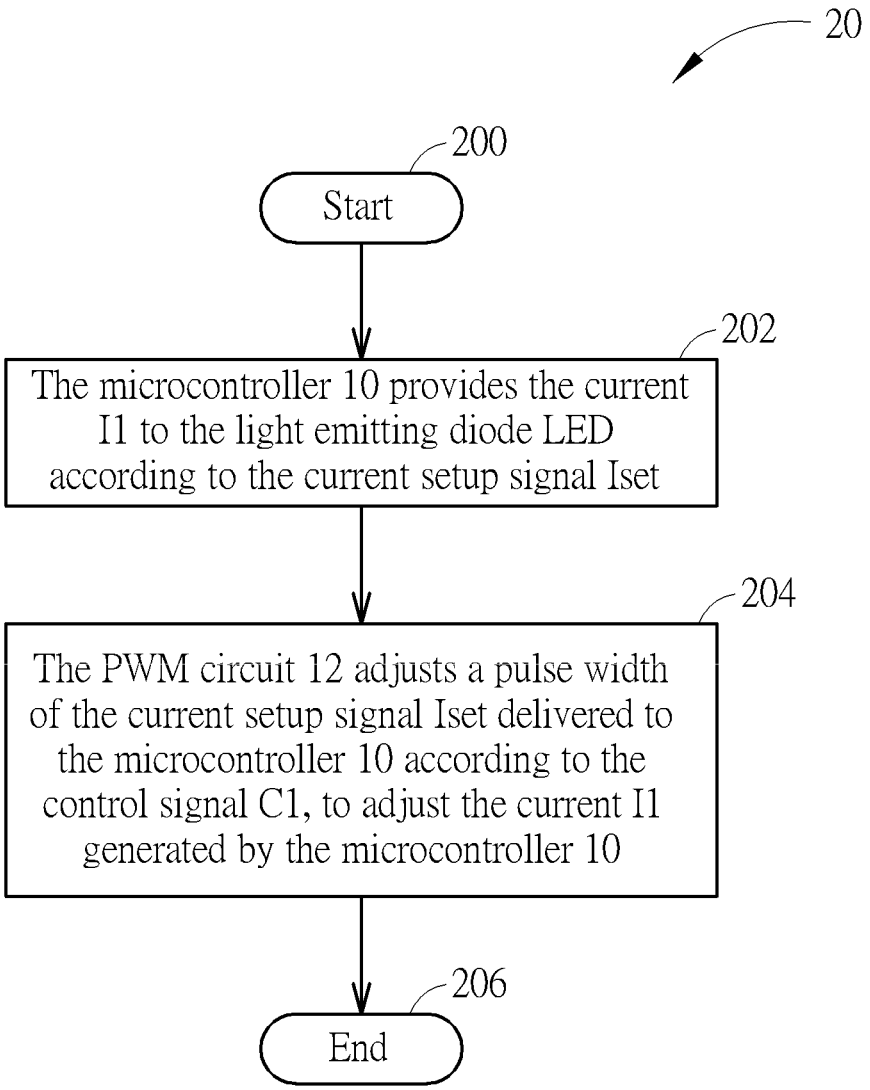
FIG. 2 is a schematic diagram of a process according to an embodiment of the present invention.

The operations of the lighting system 1 may be summarized as a control process 20, as shown in FIG. 2. The control process 20 includes the following steps:

Step 200: Start.

Step 202: The microcontroller 10 provides the current I1 to the light emitting diode LED according to the current setup signal Iset.

Step 204: The PWM circuit 12 adjusts a pulse width of the current setup signal Iset delivered to the microcontroller 10 according to the control signal C1, to adjust the current I1 generated by the microcontroller 10.

Step 206: End.

In the embodiment, the PWM circuit 12 is connected to the microcontroller 10 at a current setup pin P_Iset. The microcontroller 10 may be an LED driver, for setting the current I1 delivered to the light emitting diode LED according to a current received at the current setup pin P_Iset. In Step 202, the microcontroller 10 generates the corresponding current I1 to the light emitting diode LED according to an average current value of the received current setup signal Iset, allowing the lighting system 1 to glow.

In Step 204, the PWM circuit 12 may adjust a pulse width of the current setup signal Iset delivered to the microcontroller 10 according to the control signal C1. As such, the pulse width of the current setup signal Iset may be modulated through instructions generated by the control signal C1, which also changes the average current value of the current setup signal Iset. Under such a circumstance, the microcontroller 10 may receive the current setup signal Iset with different average current values according to different pulse widths modulated by the PWM circuit 12. The brightness of the light emitting diode LED may be precisely adjusted by the PWM circuit 12 and the microcontroller 10. Notably, the control signal C1 may be generated by the electronic system according to a default program code, such that the light emitting diode LED may glow according to a default sequence. Alternatively, the control signal C1 may be generated by the electronic system instantly corresponding to different circumstances, such that the light emitting diode LED may instantly adjust its brightness according to different circumstances. Moreover, the control signal C1 may be generated by the user through an input device, such that the light emitting diode LED may glow according to requirements of the user. As long as the control signal C1 may instruct the PWM circuit 12 for pulse width modulation, to further adjust the current I1 generated by the microcontroller 10 to the light emitting diode LED, the control signal C1 are within the scope of the present invention.

In brief, the lighting system 1 of the present invention may improve the control method of the light emitting diode LED. Through controlling the microcontroller 10 by the PWM circuit 12, the precision of the current I1 driving the light emitting diode LED may be improved. In another aspect, the present invention utilizes the PWM circuit 12 for providing the current setup signal Iset to the microcontroller 10, to adjust the brightness of the light emitting diode LED, such that the lighting system 1 may instantly and dynamically adjust the brightness of the light emitting diode LED. Therefore, the lighting system 1 of the present invention may extend functionalities of the microcontroller 10 for controlling the light emitting diode LED, which elevates product quality and meets user requirements.

Figure 3A:
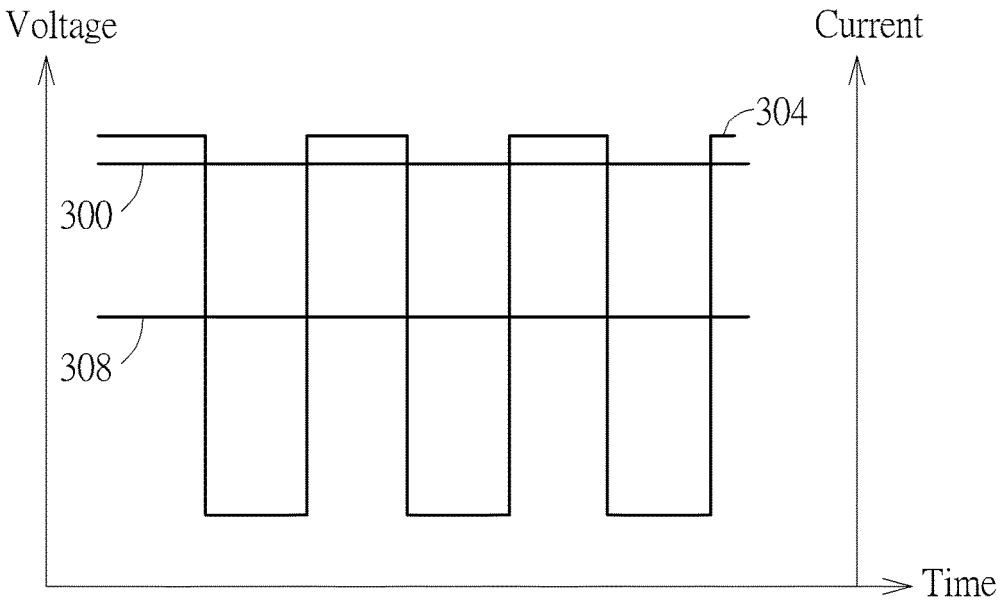
FIG. 3A illustrates a schematic diagram of a relationship between the control signal, the current setup signal and the average current value of the current setup signal Iset according to an embodiment of the present invention.
Figure 3B:
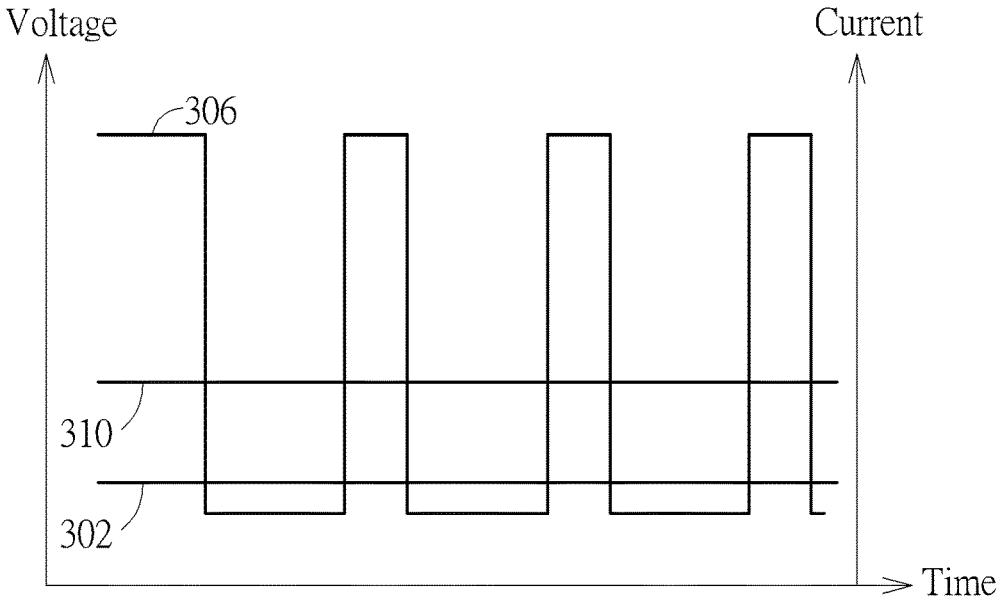
FIG. 3B illustrates a schematic diagram of a relationship between the control signal, the current setup signal and the average current value of the current setup signal Iset according to an embodiment of the present invention.

Then, please refer to FIGS. 3A, 3B. FIGS. 3A, 3B illustrate relationships between the control signal C1, the current setup signal Iset and the average current value of the current setup signal Iset of the lighting system 1. Lines 300, 302 respectively illustrate the control signals C1 at different voltage levels; lines 304, 306 respectively illustrate the current setup signals Iset corresponding to the lines 300-302; lines 308, 310 respectively illustrate the average current value of the current setup signals Iset corresponding to the lines 304-306. As shown in FIGS. 3A, 3B, the control signal C1 at a high voltage level is illustrated by the line 300, and thus, a higher pulse width ratio of the current setup signal Iset in one duty cycle is illustrated by the line 304, such that the higher average current value of the current setup signal Iset is illustrated by the line 308. The control signal C1 at a low voltage level is illustrated by the line 302, and thus, the higher pulse width ratio of the current setup signal Iset in one duty cycle is illustrated by the line 306, such that the lower average current value of the current setup signal Iset is illustrated by the line 310. As such, the PWM circuit 12 may precisely generate the current setup signal Iset with different pulse width modulations according to the control signal C1. Notably, the control signal C1 is not limited to instruct the PWM circuit 12 for generating the current setup signal Iset through the signals represented in voltage levels, as long as a signal format of the control signal C1 may be identified by the PWM circuit 12, to generate the corresponding current setup signal Iset. For instance, the control signal C1 may instruct the PWM circuit 12 through the signals represented in current levels, frequency modulations, etc., which are also within the scope of the present invention.

Figure 4:
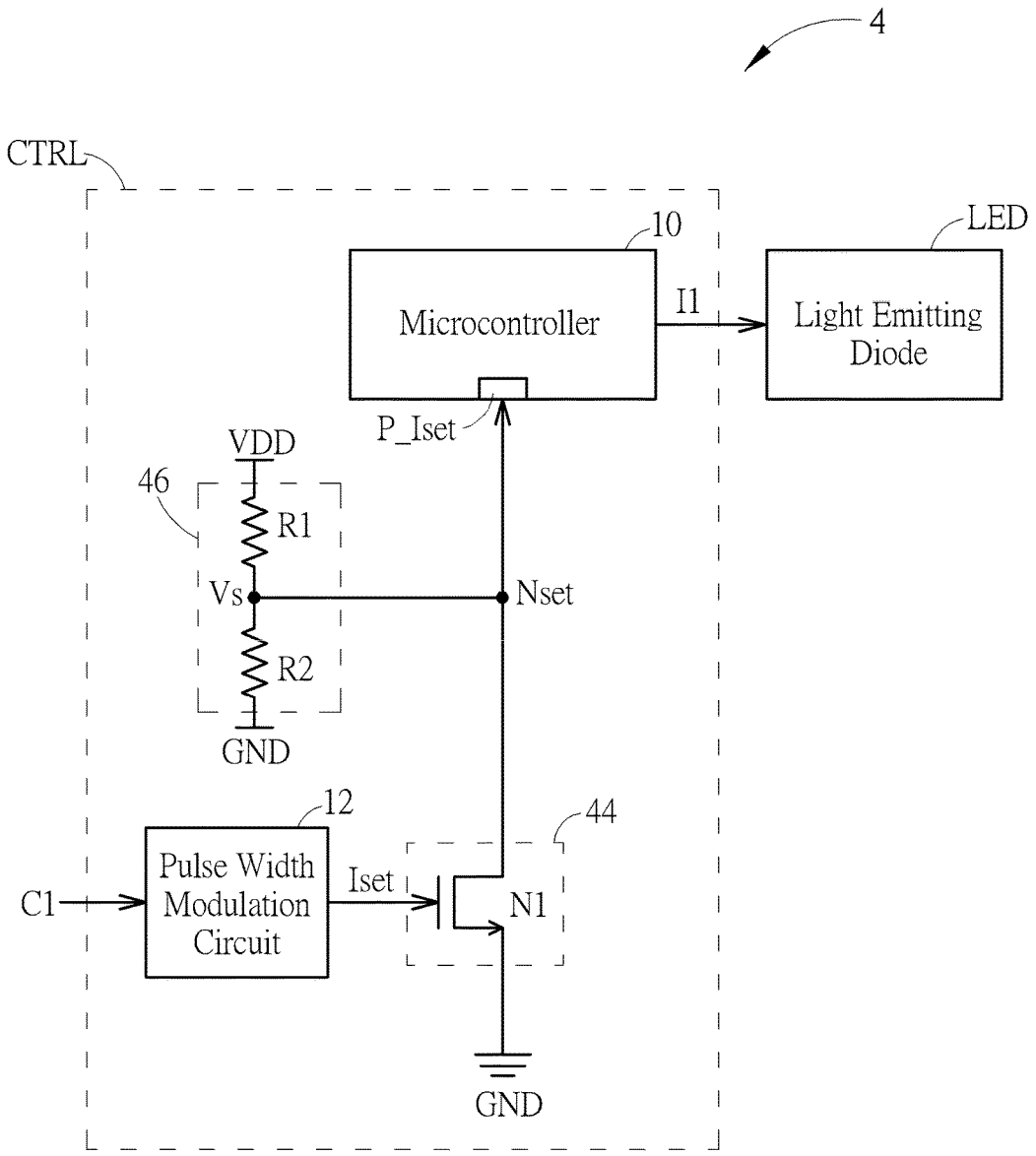
FIG. 4 is a schematic diagram of another lighting system according to an embodiment of the present invention.

Notably, although the PWM circuit 12 instructs the microcontroller 10 through the current of the current setup signal Iset for adjusting the current I1 delivered from the microcontroller 10 to the light emitting diode LED, the PWM circuit 12 may also instruct the microcontroller 10 through the voltage of the current setup signal Iset for adjusting the current I1 delivered from the microcontroller 10 to the light emitting diode LED. In detail, please refer to FIG. 4, which is a schematic diagram of a lighting system 4 according to an embodiment of the present invention. The lighting system 4 is similar to the lighting system 1, and thus, the same components are denoted by the same symbols. Under such a circumstance that the PWM circuit 12 instructs the microcontroller 10 through the voltage of the current setup signal Iset, the lighting system 4 includes a switch 44 and a bias circuit 46. In the embodiment, the switch 44 is an N-type metal-oxide-semiconductor filed-effect transistor (NMOSFET) N1, coupled to the PWM circuit 12, for selectively conducting or cutting off a connection between the microcontroller 10 and a ground GND according to the voltage of the current setup signal Iset, so as to convert the current setup signal Iset from voltage to current. The bias circuit 46 includes resistors R1, R2, coupled between a power VDD and the ground GND, wherein a node Nset between the resistors R1 and R2 is connected to the microcontroller 10, for providing a startup voltage Vs to the microcontroller 10. As such, the lighting system 4 of the present invention may control the switch 44 according to the voltage of the current setup signal Iset generated by the PWM circuit 12, and further adjust the current I1 generated by the microcontroller 10 to the light emitting diode LED.

Furthermore, a drain, a source and a gate of the NMOSFET N1 are respectively coupled to the microcontroller 10, the ground GND and the PWM circuit 12. When the voltage of the current setup signal Iset is at the high voltage level, the NMOSFET N1 may conduct a connection between the drain and the source. When the voltage of the current setup signal Iset is at the low voltage level, the NMOSFET N1 may cut off the connection between the drain and the source. Moreover, when the voltage of the current setup signal Iset is at the low voltage level and the NMOSFET N1 is cutoff, the current and the voltage at the node Nset is floating and electrically undefined. Accordingly, the current I1 generated by the microcontroller 10 to the light emitting diode LED is unstable and uncontrollable, which results in abnormal flickers of the light emitting diode LED.

Therefore, the lighting system 4 of the present invention utilizes the bias circuit 46 for providing the startup voltage Vs to the microcontroller 10. Under such a circumstance, no matter the NMOSFET N1 is conducted or cutoff, the current received by the microcontroller 10 is always stable, thus preventing abnormal flickers of the light emitting diode LED. In detail, the bias circuit 46 includes the resistors R1, R2, serially connected between the power VDD and the ground GND, wherein resistances of the resistors R1, R2 may be preferably selected, allowing a static current delivered from the power VDD to the ground GND to be low, so as to reduce a power consumption of the lighting system 4. In addition, a resistance ratio of the resistors R1, R2 may be adjusted, such that the startup voltage Vs may be biased at a highest voltage level where the microcontroller 10 is able to receive. As such, when the NMOSFET N1 is cutoff, the current received by the microcontroller 10 at the node Nset may approximate zero, which further reduces the power consumption of the lighting system 4.

Notably, the embodiments stated in the above are utilized for illustrating the concept of the present invention. Those skilled in the art may make modifications and alterations accordingly, and not limited herein. According to different applications and design concepts, the pulse width modulation circuit of the present invention may be altered. For example, under a circumstance that the microcontroller may adjust the current delivered to the light emitting diode by two levels according to the current received at the current setup pin, the current level generated by the pulse width modulation circuit of the present invention may be adjusted. The current setup signal in different current levels may be generated according to the two-level current scales which the microcontroller may identify, further increasing the lighting precision of the light emitting diode, which are also within the scope of the present invention.

The conventional control device may only turn the light emitting diode on or off, or adjust the brightness of the light emitting diode by two levels through the operations of the microcontroller. In comparison, the present invention utilizes the pulse width modulation circuit for providing the current setup signal to the microcontroller to adjust the brightness of the light emitting diode, allowing the control device to instantly and dynamically adjust the brightness of the light emitting diode LED. As such, the control device of the present invention may improve the lighting precision of the light emitting diode, for instantly and dynamically adjust the brightness of the light emitting diode. In addition, the present invention further utilizes the bias circuit for preventing the light emitting diode from abnormal flickers, which extends functionalities of the microcontroller to control the light emitting diode, elevates product quality and meets the user requirements.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A control device, for a light emitting diode (LED), wherein the LED is driven by a current to emit light, the control device comprising:

a microcontroller, coupled to the LED, for providing the current to the LED according to a current setup signal;

a pulse width modulation (PWM) circuit, coupled to the microcontroller, for generating the current setup signal, and adjusting a pulse width of the current setup signal according to a control signal, to adjust the current generated by the microcontroller; and a bias circuit, coupled to the microcontroller, for providing a startup voltage to a current setup pin.

2. The control device of claim 1, wherein the PWM circuit adjusts an average current value of the current setup signal according to the control signal.

3. The control device of claim 1, further comprising:

a switch, coupled to the microcontroller, the PWM circuit and a ground, for conducting or cutting off a connection between the microcontroller and the ground according to the current setup signal, so as to allow the microcontroller to provide the current to the LED according to the current setup signal.

4. The control device of claim 3, wherein the switch is an n-type metal oxide silicon transistor (NMOS), and a drain, a source and a gate of the NMOS are respectively coupled to the microcontroller, the ground and the PWM circuit.

5. A control method, for controlling a microcontroller to control a light emitting diode (LED), the control method comprising:

adjusting a pulse width of a current setup signal delivered to the microcontroller according to a control signal;

providing, by the microcontroller, a current to the LED and adjusting a value of the current according to the current setup signal, to adjust a brightness of the LED; and providing a startup voltage to the microcontroller.

6. The control method of claim 5, wherein the step of providing, by the microcontroller, the current to the LED and adjusting the value of the current according to the current setup signal, so as to adjust a brightness of the LED is conducting or cutting off a connection between the microcontroller and a ground according to the current setup signal, to allow the microcontroller to provide the current to the LED according to the current setup signal.

7. The control method of claim 5, wherein the step of adjusting the pulse width of the current setup signal delivered to the microcontroller according to the control signal is adjusting an average current value of the current setup signal according to the control signal.

8. A lighting system, comprising:

a light emitting diode (LED), driven by a current to emit light; and a control device, comprising:

a microcontroller, coupled to the LED, for providing the current to the LED according to a current setup signal;

a pulse width modulation (PWM) circuit, coupled to the microcontroller, for generating the current setup signal, and adjusting a pulse width of the current setup signal according to a control signal, to adjust the current generated by the microcontroller; and a bias circuit, coupled to the microcontroller, for providing a startup voltage to a current setup pin.

9. The lighting system of claim 8, wherein the control device further comprises:

a switch, coupled to the microcontroller, the PWM circuit and a ground, for conducting or cutting off a connection between the microcontroller and the ground according to the current setup signal, so as to allow the microcontroller to provide the current to the LED according to the current setup signal.

10. The lighting system of claim 9, wherein the switch is an n-type metal oxide silicon transistor (NMOS), and a drain, a source and a gate of the NMOS are respectively coupled to the microcontroller, the ground and the PWM circuit.

11. The lighting system of claim 8, wherein the PWM circuit adjusts an average current value of the current setup signal according to the control signal.

* * * * *